US007275343B2

(12) United States Patent
York

(10) Patent No.: US 7,275,343 B2
(45) Date of Patent: Oct. 2, 2007

(54) RIFLESCOPE WITH RECESSED BOTTOM SURFACE FOR REDUCED MOUNTING HEIGHT

(75) Inventor: Andrew W. York, Portland, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 246 days.

(21) Appl. No.: 11/060,444

(22) Filed: Feb. 16, 2005

(65) Prior Publication Data

US 2006/0179702 A1 Aug. 17, 2006

(51) Int. Cl.
*F41G 1/00* (2006.01)

(52) U.S. Cl. ..... 42/122; 42/111

(58) Field of Classification Search ..... 42/111–148
See application file for complete search history.

(56) References Cited

U.S. PATENT DOCUMENTS 2,517,274 A * 8/1950 Baker et al. ..... 42/127
3,516,736 A * 6/1970 Weaver ..... 359/823
D240,333 S 6/1976 Chestnut
4,509,282 A 4/1985 McMillon
4,940,324 A 7/1990 Nichols
D346,392 S 4/1994 Tomita
6,327,806 B1 * 12/2001 Paige ..... 42/113
6,811,268 B2 * 11/2004 Watson ..... 359/611
7,051,469 B1 * 5/2006 Pochapsky et al. ..... 42/111

OTHER PUBLICATIONS

Andrew W. York, U.S. Design Appl. No. 29/223,707, filed Feb. 16, 2005.
Omnitech Partners, Inc., OSTI Optical Systems Technology Star*Tron Night Vision Products—Muns Magnum Universal Night Sight, product brochure, copyright 2006 (month unknown), 2 pages.
U.S. Government Accountability Office, Decision: Matter of Optical Systems Technology, Inc., file Nos. B-296516.2; B-296516.3, Mar. 17, 2006, 11 pages.
REDFIELD, Low Profile Widefield, 1986, 1 pg.
REDFIELD, Low Profile Widefield, 1997, 1 pg.
TASCO, EXP Extreme Performance Riflescopes, 2001, 2 pgs.
Stoeger's Shooter's Bible, Ajack Hunting and Target Rifle Telescopes, 1939, p. 239.
Omnitech Partners, Inc., Universal Night Sight Family—UNS-XR®, http://www.omnitechpartners.com/osti/products/uns-xr.htm, visited Mar. 7, 2007 (publication date unknown), 1 page.

* cited by examiner

*Primary Examiner*—Michael J. Carone
*Assistant Examiner*—Stewart T Knox
(74) *Attorney, Agent, or Firm*—Stoel Rives LLP

(57) ABSTRACT

A riflescope includes an objective optic assembly with a bottom surface that defines a scoop. Upon mounting the riflescope, the scoop receives a portion of a firearm. The scoop eliminates interference between the objective optic assembly and the firearm and allows a centerline of the riflescope to be placed in closer proximity to a centerline of the firearm.

32 Claims, 4 Drawing Sheets

RIFLESCOPE WITH RECESSED BOTTOM SURFACE FOR REDUCED MOUNTING HEIGHT

BACKGROUND OF THE INVENTION

Riflescopes typically include an elongate housing comprising a substantially cylindrical main tube, with outwardly flared ends. Referring to FIGS. 1A and 1B, a conventional riflescope 10 is shown that has an outer tubular housing 12 with a flared objective end 14 and a flared eyepiece end 16. An adjustment mechanism 18 may be located between the objective and eyepiece ends 14, 16 along the main tube. Riflescope 10 is held securely by front and rear mounting rings 20, 22 placed on either side of adjustment mechanism 18 and which are mountable to a mounting base secured to firearm 24. For purposes of standardization and for reducing part inventories, riflescope main tubes and mounting rings have conventionally been sized 1-inch diameter, 26 mm diameter, or 30 mm diameter.

Mounting a riflescope 10 lower on firearm 24 places a centerline 26 of riflescope 10 closer to a centerline 28 of firearm 24. The increased centerline proximity improves operation of firearm 24, as a user is able to keep the user's cheek on the rifle stock while having the user's eye as close as possible to the top of the firearm barrel. The present inventors have recognized that increased contact between cheek and stock (i.e. "cheek weld") allows for an improved static position to increase accuracy. If a user needs to raise his or her eye to view the eyepiece, cheek contact with the stock may be lost, which increases inaccuracy.

As shown in FIGS. 1A and 1B, objective end 14 determines the proximity of riflescope 10 to firearm 24. As the objective optic increases, the distance between riflescope centerline 26 and firearm centerline 28 also increases. This situation becomes even more apparent with 30 mm or greater sized objective optics. Larger objective optics are desired to increase light gathering and improve visibility.

A prior art riflescope sold by the Redfield Optics division of Meade Instruments Corporation under the name WIDE-FIELD uses an oval-shaped objective optic design to gain a wider field of view.

U.S. Pat. No. 4,940,324 discloses an electronic sight with lenses that have a horizontal field of view greater than a vertical field of view. The lenses do not provide added magnification and do not reduce interference between the riflescope and the firearm.

The present inventors have recognized a need for an improved projectile weapon aiming system for increasing centerline proximity between riflescope and firearm.

SUMMARY

In accordance with preferred embodiments, a riflescope includes a tubular housing with an eyepiece assembly coupled to one end of the housing. An opposing end of the housing is coupled to an objective optic assembly. The objective optic assembly may be nearly circular in cross-section except for a scoop that is formed on its bottom surface. The objective optic assembly includes an objective housing and an objective optic supported within the objective housing. The objective housing and objective optic include scooped bottom surfaces.

Upon mounting the riflescope to a firearm, the scoop provides clearance for a portion of the firearm which may nest in the scoop. In this manner, the longitudinal centerline of the riflescope can be placed lower, i.e., in closer proximity to the firearm. This lower mounting position may improve the user's ability to form a good cheek weld against the rifle stock, to thereby increase stability when aiming. This is in contrast with conventional large-objective scopes wherein the scope is mounted higher on the rifle and the user's head may need to be held above the stock in order to view a target through the riflescope. Aiming precision may also be improved with riflescopes in accordance with the disclosed embodiments, as the aiming axis (e.g. longitudinal centerline) of the riflescope is closer to the firearm and can therefore be more closely aligned with the bore of the firearm barrel. A viewed image remains substantially circular, and the removed optic material created by the scoop does not perceptually impair visibility.

Additional aspects and advantages of this invention will be apparent from the following detailed description of preferred embodiments, which proceeds with reference to the accompanying drawings.

DETAILED DESCRIPTION OF PREFERRED EMBODIMENTS

Throughout the specification, reference to "one embodiment," "an embodiment," or "some embodiments" means that a particular described feature, structure, or characteristic is included in at least one embodiment. Thus appearances of the phrases "in one embodiment," "in an embodiment," or "in some embodiments" in various places throughout this specification are not necessarily all referring to the same embodiment.

Furthermore, the described features, structures, characteristics, and methods may be combined in any suitable manner in one or more embodiments. Those skilled in the art will recognize that the various embodiments can be practiced without one or more of the specific details or with other methods, components, materials, etc. In other instances, well-known structures, materials, or operations are not shown or not described in detail to avoid obscuring aspects of the embodiments.

Figure 1A:
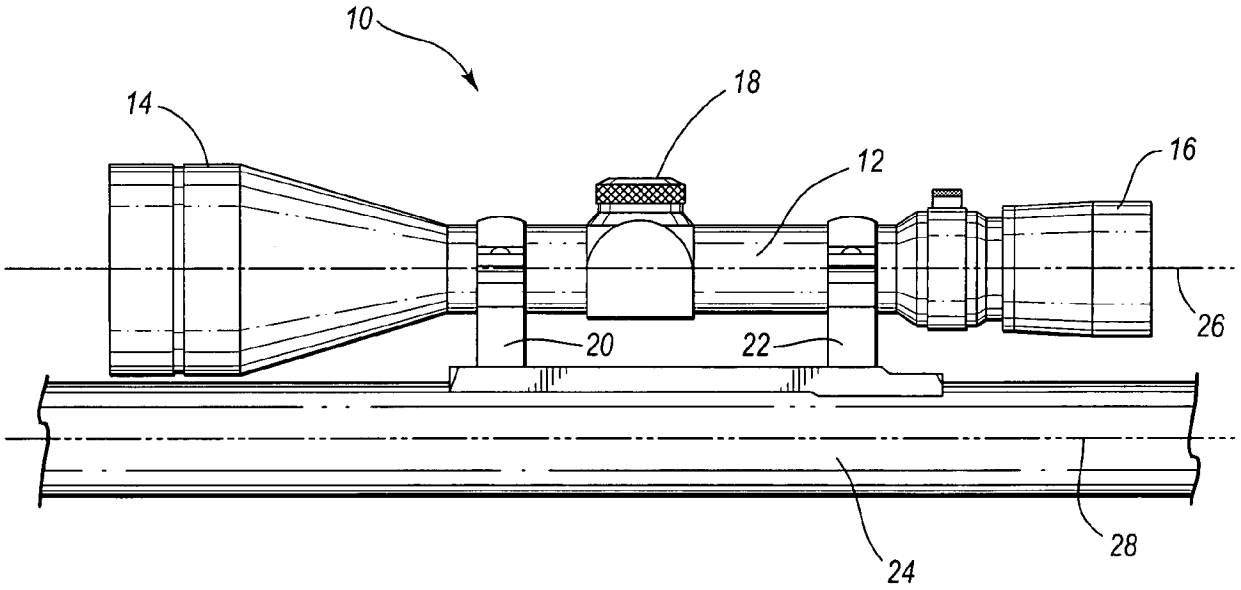
Fig. 1A (Prior Art)
FIG. 1A is a side view of a riflescope mounted on a rifle.
Figure 1B:
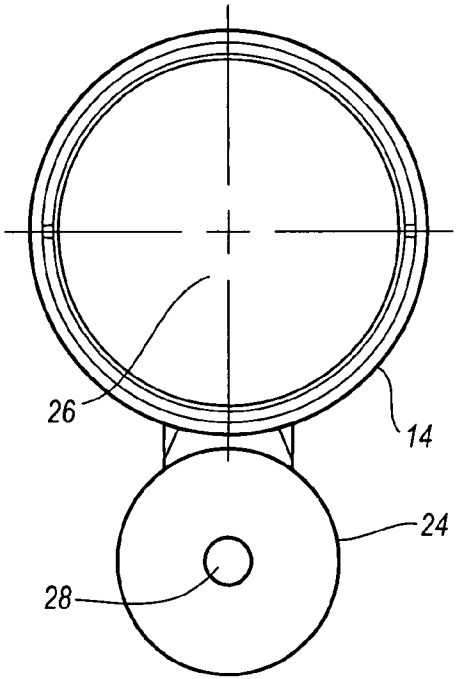
Fig. 1B (Prior Art)
FIG. 1B is a front view of the riflescope of FIG. 1A.
Figure 2A:
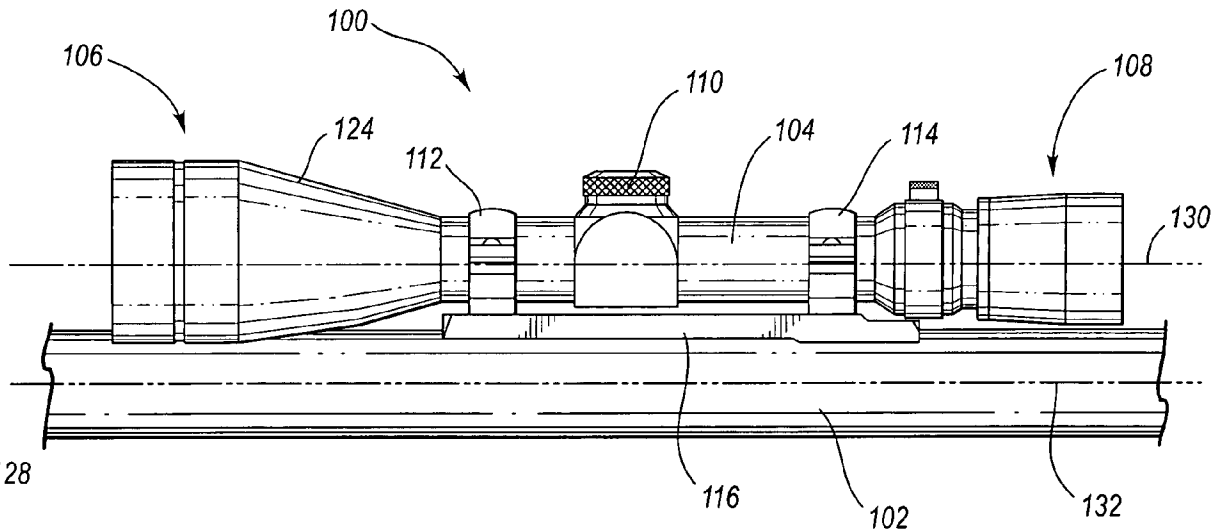
FIG. 2A is a side view of a riflescope in accordance with an embodiment.

Referring to FIG. 2A, a side view of an embodiment of a riflescope 100 mounted to a firearm 102 is shown. Riflescope 100 includes a tubular housing 104 that supports, at opposite ends, an objective optic assembly 106 and an eyepiece optic assembly 108. Objective optic assembly 106 and eyepiece optic assembly 108 are typically bell-shaped to accommodate converging and diverging light rays passing therethrough. An adjustment mechanism 110 may be located proximate the midpoint of riflescope 100 to modify focus of an image. Front and rear mounts 112, 114 couple to riflescope 100 and to a mounting base 116. Mounting base 116 engages firearm 102 by bolts, screws, clips, or other fastening devices.

Figure 2B:
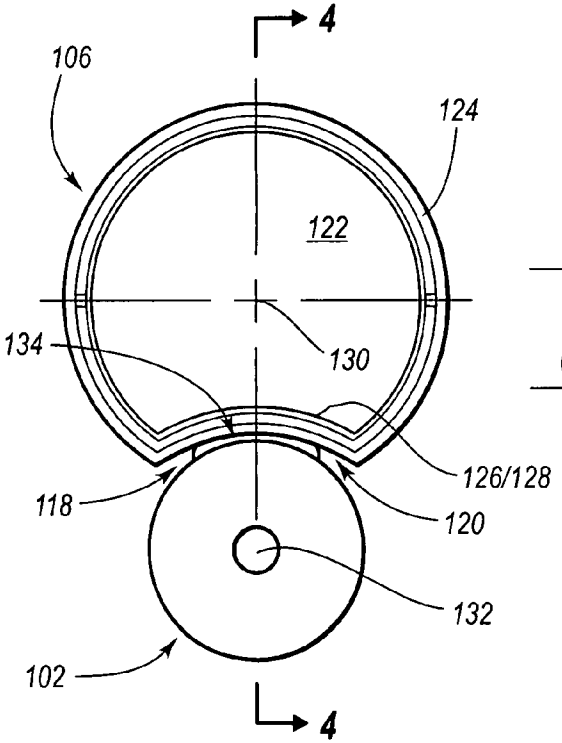
FIG. 2B is a front view of the riflescope of FIG. 2A.

Referring to FIG. 2B, and with continued reference to FIG. 2A, a front view of objective optic assembly 106 and firearm 102 is shown. The majority of objective optic assembly 106 has a cross-sectional circular shape as is common in the art to provide a circular image. However, a bottom surface 118 of objective optic assembly 106 includes a hollowed-out place, recess, or scoop 120. Bottom surface 118 is identified as the portion of objective optic assembly 106 placed in proximity to firearm 102 when riflescope 100 is mounted. Scoop 120 eliminates interference between riflescope 100 and firearm 102. By eliminating interference, riflescope 100 is mounted in closer proximity to firearm 102. Scoop 120 may be concave with a cross-sectional form of an arc segment to accommodate a curvilinear outer surface of firearm 102 as illustrated in FIGS. 2A-2B. In this embodiment, bottom surface 118 may remain approximately equidistant to firearm 102 when mounted.

Objective optic assembly 106 includes an objective optic 122 and an objective housing 124 that are both designed in accordance with the shape of scoop 120. Objective optic 122 includes two opposing faces and a periphery with a bottom surface 126 that defines a scoop 128. A larger-sized objective optic 122 may be used to increase light gathering while reducing the distance between a riflescope centerline 130 and a firearm centerline 132. Scoop 120 may have alternative cross-sectional shapes to accommodate various firearm shapes or based on design constraints. Objective optic 122 may include glass that is ground into the desired shape. Alternatively, objective optic 122 may include plastic that is molded into the desired shape.

Objective housing 124 may begin as a cylindrical workpiece that is formed on a lathe. The workpiece may then be pressed or fitted into a conforming shape by hydro-forming or impact forming techniques. Objective housing 124 may also be formed by machining material to the desired dimensions. The completed objective housing 124 includes a scoop section 134 shaped to support objective optic 122 along scoop 128. Objective housing 124 may be coupled to tubular housing 104 or may be integrally formed of unitary construction with tubular housing 104.

Figure 3A:
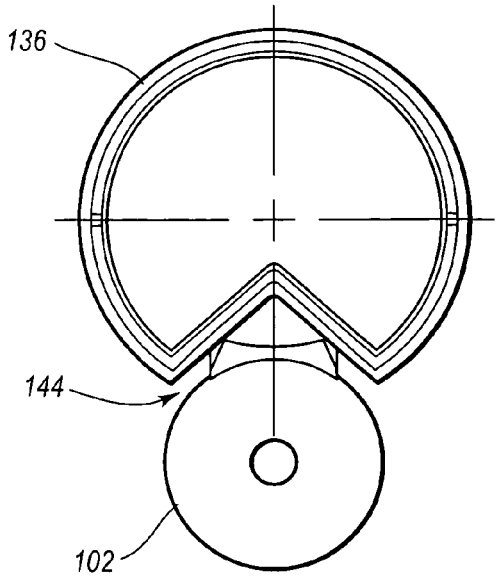
FIG. 3A is a front view of an alternative embodiment of a riflescope.
Figure 3B:
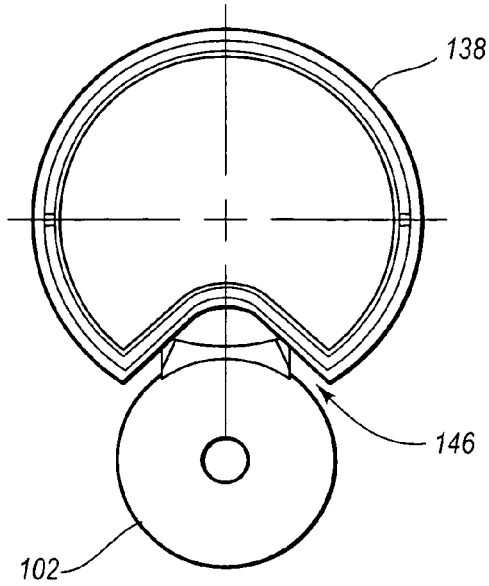
FIG. 3B is a front view of an alternative embodiment of a riflescope.
Figure 3C:
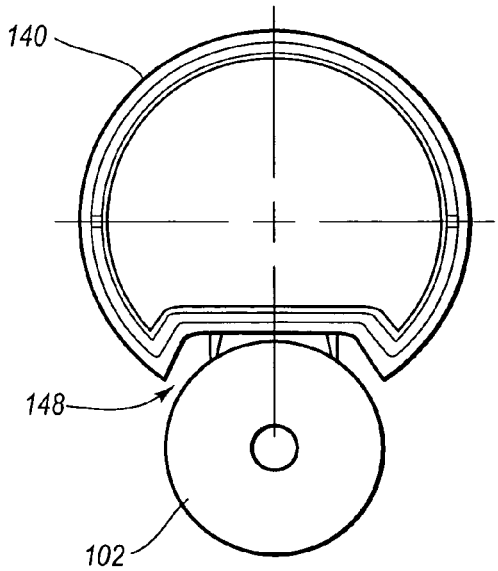
FIG. 3C is a front view of an alternative embodiment of a riflescope.
Figure 3D:
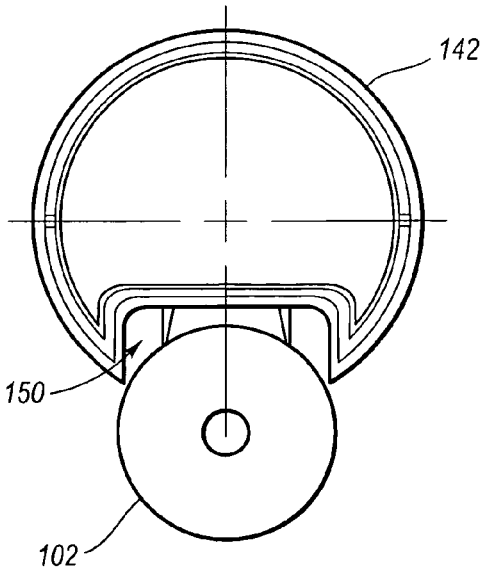
FIG. 3D is a front view of an alternative embodiment of a riflescope.

Referring to FIGS. 3A-3D, front views of alternative embodiments 136, 138, 140, 142 for objective optic assembly 106 are shown. In FIG. 3A, a scoop 144 has a triangular-shaped cross-section to form a pie-piece cavity. In FIG. 3B, a scoop 146 has a rounded, triangular-shaped cross-section. In FIG. 3C, a scoop 148 has a trapezoidal-shaped cross-section. In FIG. 3D, a scoop 150 has a rectangular cross-section. One of skill in the art will appreciate that the shape of a scoop may vary so long as the scoop allows firearm 102 to partially nest within objective optic assembly 106.

Figure 4:
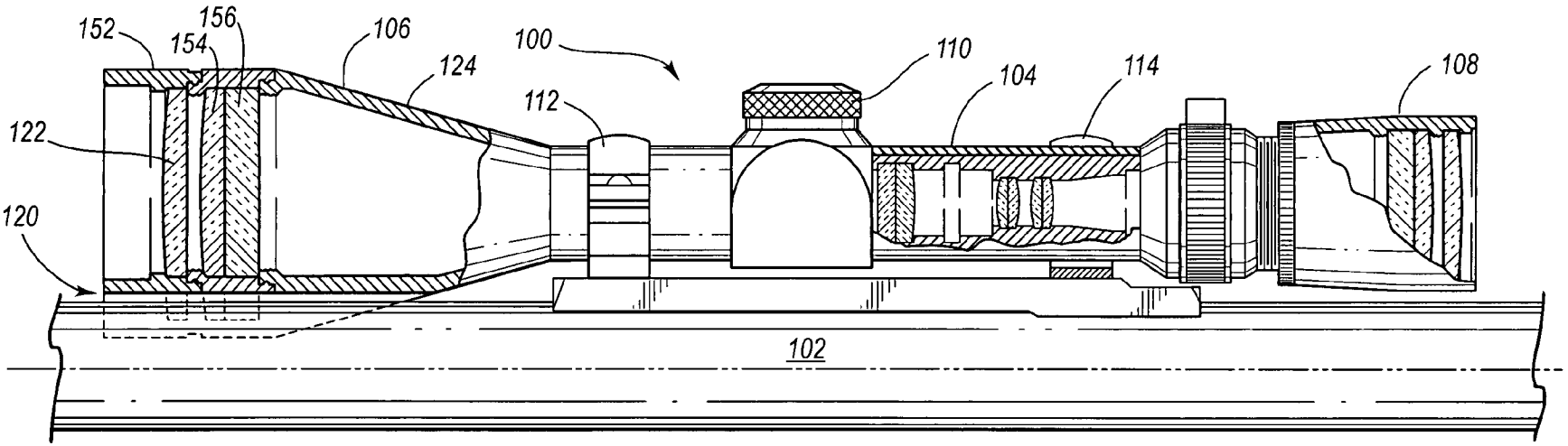
FIG. 4 is a cross-sectional view of the riflescope of FIGS. 2A and 2B taken along line 4-4 of FIG. 2B.

Referring to FIG. 4, a cross-sectional view of riflescope 100 of FIG. 2A taken along line 4-4 of FIG. 2B is shown. Objective optic assembly 106 rests above firearm 102. Preferably, when riflescope 100 is mounted, scoop 120 provides some distance between firearm 102 and objective optic assembly 106. This configuration reduces vibration and stress to objective optic 122 during firearm discharge.

Objective optic assembly 106 includes a detachable front end member 152 that is shaped to define scoop 120 and to support objective optic 122. In manufacturing, objective optic 122 is positioned and supported within objective housing 124. Front end member 152 then couples to objective housing 124 and retains the periphery of objective optic 122 between front end member 152 and objective housing 124. Coupling front end member 152 to objective housing 124 may be achieved by press fitting or by application of adhesives. Upon coupling front end member 152, a hermetic seal is created to retain an inert gas within the interior of the riflescope. Gaskets, elastomers, or adhesives may be disposed between the periphery of objective optic 122 and front end member 152 and/or objective housing 124 to ensure the seal.

In more sophisticated riflescopes, objective optic assembly 106 may include one or more additional objective optics 154, 156 as shown in FIG. 4. Objective optics 154, 156 operate with objective optic 122 to modify convergence of light rays. Similar to objective optic 122, objective optics 154, 156 are shaped to accommodate scoop 120. Objective optics 154, 156 may be manufactured and disposed within objective housing 124 using the same techniques as used for objective optic 122. Thus the objective optic may comprise a singlet lens 122 and a doublet lens 154/156 combination as illustrated in FIG. 4.

Figure 5:
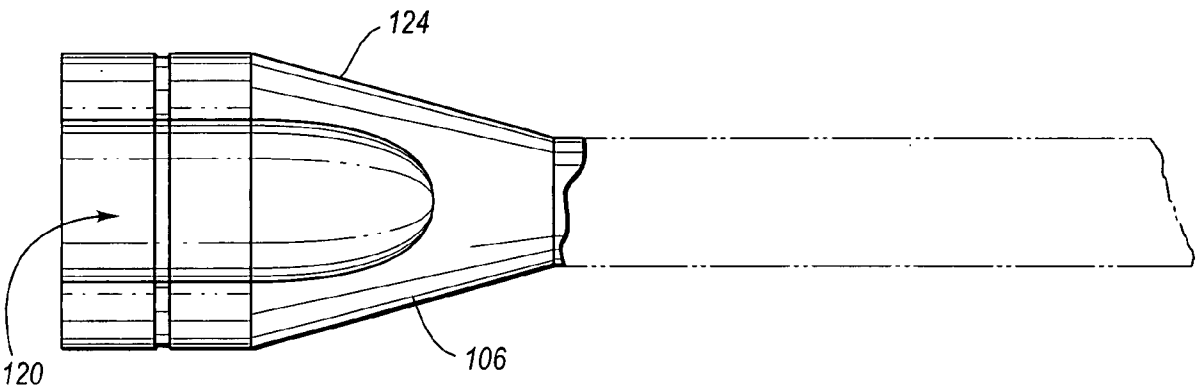
FIG. 5 is a bottom view of the riflescope of FIGS. 2A-2B.

Referring to FIG. 5, a bottom view of objective optic assembly 106 of FIGS. 2A-2B is shown. Scoop 120 increases in width and depth as objective optic assembly 106 longitudinally extends from tubular housing 104. The scoop's longitudinally diverging shape receives and accommodates firearm 102 in a nested arrangement, as objective optic assembly 106 diverges toward firearm 102.

Riflescope 100 retains a traditional look and functionality except for the appearance of scoop 120. Scoop 120 removes a small amount of objective optic 122, but there is no perceivable visual effect when viewing through riflescope 100. Thus an image produced by riflescope 100 appears substantially circular. Furthermore, as scoop 120 is only a small area of the added circumference of objective optic 122, riflescope 100 benefits from a large objective optic 122 with good light-gathering ability.

The result is that the light-gathering benefit of a large objective optic 122 is now mountable at a height that was previously available only with smaller objective optics. Riflescope 100 may be placed at a height that is easier to use in the field, with centerline 130 of riflescope 100 closer to firearm centerline 132. This can allow a user to keep his or her cheek on the stock of firearm 102 while sighting a target through riflescope 100 and thereby create a secure check weld. An improved check weld provides superior stability and improved aiming accuracy. Aiming precision may also be improved as the distance between centerlines 130, 132 is reduced, because the aiming axis of the riflescope can thereby be more closely aligned with the bore of the firearm barrel when the riflescope is sighted in.

By incorporating the design of the present invention, it is anticipated that a riflescope with a 56-mm objective optic could be mounted like a conventional riflescope with a 40-mm objective optic. Similarly, a 50-mm riflescope could be mounted like a conventional 36-mm riflescope, and a 40-mm riflescope could be mounted like a conventional 28-mm riflescope.

Those skilled in the art will appreciate that the overall shape of riflescope 100 and the shape of scoop 120 are matters of design choice and may be different from the shape and positioning shown herein. However, the riflescope described herein is not limited to use with rifles, but may also be used in various other types of sighting devices and projectile weapon aiming devices and may be used to aim one or more of a variety of projectile weapons, such as pistols and others. Thus it will be obvious to those having skill in the art that many changes may be made to the details of the above-described embodiments without departing from the underlying principles of the invention. The scope of the present invention should, therefore, be determined only by the following claims.

The invention claimed is:

1. A riflescope, comprising:

a tubular housing; and an objective optic assembly at an end of the tubular housing, including, an objective housing, an objective optic disposed within the objective housing and having a periphery with a bottom surface that defines a scoop, and wherein the objective housing includes a scoop section shaped to support the objective optic along the scoop thereof, the scoop section facilitating reduced mounting height.

2. The riflescope of claim 1, wherein the scoop is concave with an arc-shaped cross-section.

3. The riflescope of claim 1, wherein the scoop has a triangular-shaped cross-section.

4. The riflescope of claim 1, wherein the scoop has a rounded, triangular-shaped cross-section.

5. The riflescope of claim 1, wherein the scoop has a trapezoidal cross-section.

6. The riflescope of claim 1, wherein the scoop has a rectangular cross-section.

7. The riflescope of claim 1, wherein the objective optic assembly includes a detachable front end member to enable access to the objective optic.

8. The riflescope of claim 1, wherein the scoop has a round arc-shaped cross-section.

9. The riflescope of claim 1, wherein the objective optic comprises a singlet lens and a doublet lens combination.

10. A riflescope, comprising:

a tubular housing; and an objective optic assembly coupled at an end of the tubular housing, including, an objective housing, and an objective optic disposed within the objective housing and having a periphery with a bottom surface that defines a scoop that interrupts an otherwise circular cross-section of the objective optic, wherein the objective housing includes a scoop section shaped to support the objective optic along the scoop thereof, the scoop section of the objective housing facilitating reduced mounting height.

11. The riflescope of claim 10, wherein the scoop is concave with an arc-shaped cross-section.

12. The riflescope of claim 10, wherein the scoop has a triangular-shaped cross-section.

13. The riflescope of claim 10, wherein the scoop has a rounded, triangular-shaped cross-section.

14. The riflescope of claim 10, wherein the scoop has a trapezoidal cross-section.

15. The riflescope of claim 10, wherein the scoop has a rectangular cross-section.

16. The riflescope of claim 10, wherein the objective optic assembly includes a detachable front end member to enable access to the objective optic.

17. The riflescope of claim 10, wherein the scoop has a round arc-shaped cross-section.

18. An objective optic assembly for use with a riflescope, comprising:

an objective housing; and an objective optic disposed within the objective housing and having a periphery with a bottom surface that defines a scoop, wherein the objective housing includes a scoop section shaped to support the objective optic along the scoop thereof, the scoop section facilitating reduced mounting height.

19. The objective optic assembly of claim 18, wherein the scoop is concave with an arc-shaped cross-section.

20. The objective optic assembly of claim 18, wherein the scoop has a triangular-shaped cross-section.

21. The objective optic assembly of claim 18, wherein the scoop has a rounded, triangular-shaped cross-section.

22. The objective optic assembly of claim 18, wherein the scoop has a trapezoidal cross-section.

23. The objective optic assembly of claim 18, wherein the scoop has a rectangular cross-section.

24. The objective optic assembly of claim 18, further including a detachable front end member to enable access to the objective optic.

25. The objective optic assembly of claim 18, wherein the scoop has a round arc-shaped cross-section.

26. An objective optic for use with a riflescope, comprising:

first and second opposing faces; and a periphery having a bottom surface that defines a scoop.

27. The objective optic of claim 26, wherein the scoop is concave with an arc-shaped cross-section.

28. The objective optic of claim 26, wherein the scoop has a triangular-shaped cross-section.

29. The objective optic of claim 26, wherein the scoop has a rounded, triangular-shaped cross-section.

30. The objective optic of claim 26, wherein the scoop has a trapezoidal cross-section.

31. The objective optic of claim 26, wherein the scoop has a rectangular cross-section.

32. The objective optic of claim 26, wherein the scoop has a round arc-shaped cross-section.

* * * * *